US008151739B2

(12) United States Patent
Mussmann et al.

(10) Patent No.: US 8,151,739 B2
(45) Date of Patent: Apr. 10, 2012

(54) DEVICE WITH FLUID DISTRIBUTOR AND MEASURED VALUE RECORDING AND METHOD FOR OPERATION OF A BOILER WITH A THROUGHFLOW OF FLUE GAS

(75) Inventors: Bernd Mussmann, Rheinberg (DE); Manfred Frach, Wesel (DE)

(73) Assignee: Clyde Bergemann GmbH, Wesel (DE)

( * ) Notice: Subject to any disclaimer, the term of this patent is extended or adjusted under 35 U.S.C. 154(b) by 850 days.

(21) Appl. No.: 12/184,457

(22) Filed: Aug. 1, 2008

(65) Prior Publication Data

US 2009/0044765 A1 Feb. 19, 2009

Related U.S. Application Data

(63) Continuation of application No. PCT/EP2007/000900, filed on Feb. 2, 2007.

(30) Foreign Application Priority Data

Feb. 3, 2006 (DE) ..... 10 2006 005 012

(51) Int. Cl.
*F22B 37/52* (2006.01)

(52) U.S. Cl. ..... 122/390; 122/379; 134/167 R; 134/172

(58) Field of Classification Search ..... 122/379, 122/381, 383, 390, 398, 402, 405; 134/167 R, 134/172, 180, 181
See application file for complete search history.

(56) References Cited

U.S. PATENT DOCUMENTS

| | | | | |
|---|---|---|---|---|
| 4,552,098 | A * | 11/1985 | Wynnyckyj et al. | 122/379 |
| 5,036,871 | A * | 8/1991 | Ruggieri et al. | 134/167 R |
| 5,065,703 | A * | 11/1991 | Lee | 122/382 |
| H001115 | H * | 12/1992 | Nachbar | 165/11.1 |
| 5,813,370 | A * | 9/1998 | Owen et al. | 122/382 |
| 6,192,904 | B1 * | 2/2001 | Secknus et al. | 134/167 R |
| 6,681,839 | B1 * | 1/2004 | Balzer | 165/11.2 |
| 6,820,575 | B2 * | 11/2004 | Ashton et al. | 122/379 |
| 7,086,353 | B2 * | 8/2006 | Hwang et al. | 122/380 |
| 7,162,981 | B2 * | 1/2007 | Hernandez | 122/379 |
| 7,204,208 | B2 * | 4/2007 | Johnson et al. | 122/379 |
| 7,464,670 | B2 * | 12/2008 | Hermamdez et al. | 122/379 |
| 2002/0108644 | A1 * | 8/2002 | Hoadley et al. | 134/172 |

FOREIGN PATENT DOCUMENTS

| | | | |
|---|---|---|---|
| DE | 239 656 | A1 | 7/1985 |
| DE | 281 452 | B5 | 7/1987 |
| DE | 196 40 337 | A1 | 9/1996 |
| DE | 100 09 831 | A1 | 3/2000 |
| EP | 1 259 762 | B1 | 12/2005 |
| WO | 96/38704 | | 12/1996 |
| WO | 01/65179 | A1 | 3/2001 |
| WO | 2004/005834 | A1 | 7/2003 |

* cited by examiner

*Primary Examiner* — Gregory A Wilson
(74) *Attorney, Agent, or Firm* — BainwoodHuang

(57) ABSTRACT

Certain techniques involve the use of a device including a fluid distributor which has at least one flow duct with an inlet opening and an outlet opening. The inlet opening can be connected to a supply line for a fluid. Means for moving the fluid distributor are provided. Additionally, means are provided for recording an environmental parameter through the outlet opening.

20 Claims, 3 Drawing Sheets

DEVICE WITH FLUID DISTRIBUTOR AND MEASURED VALUE RECORDING AND METHOD FOR OPERATION OF A BOILER WITH A THROUGHFLOW OF FLUE GAS

CROSS-REFERENCE TO RELATED APPLICATIONS

This application claims the benefit under 35 U.S.C. § 120 of PCT patent application PCT/EP2007/000900.

BACKGROUND OF THE INVENTION

The present invention relates to a device comprising a fluid distributor which has at least one flow duct with an inlet opening and an outlet opening, wherein the inlet opening can be connected to a supply line for a fluid, and means for moving the fluid distributor are provided. Devices of this type can be used, for example, for cleaning boilers of a combustion system. Furthermore, the invention also relates to a method for operation of a boiler with a throughflow of flue gas using such a device.

In connection with the operation of combustion systems, it is of particular interest to obtain a high degree of efficiency for the energy conversion. For this purpose, the hot flue gas is guided past a plurality of heat exchangers such that the heat is transmitted to a heat exchange medium, in particular water, flowing in the heat exchangers. However, when the hot flue gas makes contact with said heat exchangers, impurities, soot and the like remain stuck thereto and over the medium term obstruct the transfer of heat from the flue gas to the heat exchange medium. It is therefore necessary to free the heat exchangers at predetermined intervals from said impurities.

To clean said heat exchange surfaces or else the boiler wall use is made, for example, of cleaning appliances as described, for example, in WO 96/38704. A cleaning appliance of space-saving construction is also revealed in EP 1 259 762 B1.

Said cleaning appliance, in particular a "water lance blower", has a water lance with which a bunched water jet can be discharged through the boiler chamber onto an opposite wall or onto a heat exchanger, with the impurities adhering there being removed as a result. Cleaning in this way can take place during the operation of the combustion system. In order to carry out this cleaning process, the impact region of the water jet, also referred to as the blowing pattern, is guided along a predetermined path on the surface to be cleaned. The path generally runs in a meandering manner and specifically avoids obstacles, openings or other sensitive zones in the cleaning region. Owing to the kinetic energy of the water jet and to the abrupt evaporation of water which has penetrated the pores of the deposits, a flaking-off of the dirt consisting of soot, slag and ash is brought about.

Furthermore, it is known to use diverse sensor arrangements to check and to monitor the soiling of the heat exchange surfaces or of the boiler wall and then to undertake specific cleaning. For example, DE 196 40 337 reveals a method for assessing and cleaning off coatings of slag on a heating surface, wherein the temperature of the heat exchange method is measured at selected pipes of the heating surface in the interior of a steam boiler. This measured temperature is compared with a reference temperature of a clean heating surface. As a result of this comparison, it can then be decided whether the transfer of heat is still sufficient or whether cleaning has to be carried out. Furthermore, DE 196 05 287 reveals a method and a system for controlling the running time of a boiler. In this case, it is also proposed that it is expedient, in order to generate further information about the deposition mechanism or ash particles flowing past, to record and to analyze the temperature distribution of the environment of the deposit. It is possible in this connection to identify, for example, hot ash particles which may result in caking upstream on the boiler wall or on the internal components. In order to record information of this type, it is proposed to provide a deposition sensor, for example a CCD camera, which projects into the boiler.

A selective cleaning method which is particularly effective and can be carried out in a simple manner is also revealed in DD 281452 B5 in which the boiler walls which are to be cleaned are divided into separate surfaces and are monitored. Cleaning processes for said separate surfaces are initiated specifically only when predetermined characteristic values are reached.

Further methods for monitoring the operating parameters of the combustion or for monitoring the deposits in the interior of the boiler are "thermography", "sound pyrometry" or "infrared pyrometry". With the aid of such measured value recording systems, information about the temperature of objects in the interior of the boiler, about the temperature of the flue gas, about the flow velocity of the flue gas, about adhering impurities, etc. can be determined.

SUMMARY OF THE INVENTION

The systems currently employed for monitoring the combustion operations, the degree of slag coating the heat exchangers, the cleaning of heat exchangers and the control of said individual operations continue to be highly complex and expensive. The option of checking information obtained is also at least sometimes lacking, and therefore unnecessary cleaning operations are frequently still carried out. Furthermore, combustion systems which are not yet designed with a monitoring system with regard to the combustion operations in the interior of the boiler can only be retrofitted at very high cost, with it frequently being necessary to break through the boiler wall. Consequently, the installation also requires the boiler to be shut down for a relatively long amount of time.

In light thereof, it is the object of the present invention to at least partially solve the problems described with regard to the prior art. In particular, devices and methods leading to more efficient operation of a combustion system are to be provided. In addition, an option is also to be provided as to how a combustion system which is already in existence can be rapidly and cost-effectively supplemented with a means of monitoring the boiler chamber.

These objects are achieved by means of a device according to the features of patent claim 1 and a method for operation of a boiler with a throughflow of flue gas according to the features of patent claim 13. Further advantageous refinements of the invention are provided in the dependent patent claims. It should be pointed out that the features cited individually in the patent claims can be combined with one another in any desired technologically expedient manner, and show further refinements of the invention. The description, in particular in conjunction with the figures, also discloses developments of the invention.

According thereto, the device according to the invention comprises a fluid distributor which has at least one flow duct with an inlet opening and an outlet opening, wherein the inlet opening can be connected to a supply line for a fluid, and means for moving the fluid distributor are provided, and in which means are additionally provided for recording an environmental parameter through the outlet opening.

A "fluid distributor" means in particular a tube-like construction which comprises a flow duct in its center. The fluid distributor is generally an elongate tube, with it being possible for curvatures, widened portions or constrictions (for example for influencing the flow behavior of the fluid), connections, add-on components and the like to be provided in the vicinity of at least one end region. The fluid distributor constitutes in particular a "blasting pipe" for a cleaning appliance. It is also entirely possible for the device to have a plurality of fluid distributors and/or else for a fluid distributor to have a plurality of flow ducts. However, the embodiment of the device with an individual fluid distributor which has an individual flow duct is preferred. In addition, the inlet opening can comprise adaptors, connections, valves and the like such that a supply line for a fluid (water, steam, air, etc.) can be fastened to the fluid distributor in such a manner that the connection withstands even high movement speeds or accelerations during operation. The supply line is advantageously flexible and should be at least partially stable at high temperatures. One option with regard to the configuration of a supply line of this type is a metal hose, with it being possible for the latter to also comprise a plurality of concentric hose casings.

Furthermore, means for moving the fluid distributor are provided. Said means can comprise mechanical, magnetic, electromechanical, pneumatic or other drives. "Moving" is understood in particular as meaning pivoting, but it is also possible for a rotation and/or displacement of the fluid distributor to take place in this case. In principle, it is also possible for a plurality of types of movement to be at least temporarily combined.

According to the invention, means are additionally provided for recording an environmental parameter through the outlet opening. The means can comprise in particular sound generators, sound receivers, optical units (camera, pyrometer, laser, etc.), radiation conductors, sensors, holders for at least one of the abovementioned elements, and the like. Environmental parameter is understood in particular as meaning a state variable in the interior of the boiler, such as, for example, the internal temperature of the boiler, the flow velocity and/or the temperature of the flue gas, the distance from an object in the interior of the boiler, the degree of slag coating the heat exchangers, the reflection behavior of components and/or internal components of the boiler, or the like. In particular, the environmental parameter also comprises average values, planar and/or three-dimensional distributions of the parameter, the changing behavior of the parameter and the like. Even though it is basically possible to record diverse environmental parameters at the same time or offset in time, a simple construction of the device with means for recording just one environmental parameter is preferred.

The recording of environmental parameters located outside the fluid distributor or in the interior of the boiler takes place through the outlet opening, with it being possible for this to take place without contact. Accordingly, it is possible, for example, for the means for recording an environmental parameter not to protrude beyond the outlet opening of the fluid distributor and/or to be in contact (at least temporarily) directly with the interior space of the boiler.

The advantage of the device is that the fluid distributor can now not only be used as a cleaning appliance but rather obtains a further function. In this case, for variable use of the means for recording the environmental parameter, use can be made, for example, of the drives of the fluid distributor and/or of the device. Systems which already comprise a fluid distributor of this type can also easily be retrofitted with an environmental parameter recording system of this type, since only the fluid distributor has to be exchanged. New bores or hatches in a boiler wall can thus be avoided. In addition, the rapid exchange of the fluid distributor ensures that long shutdown times of the boiler can be avoided.

According to a development of the device, it is advantageous if the means for recording an environmental parameter comprise at least one measured value pickup which is arranged connected to the at least one flow duct. This can mean firstly, for example, that the measured value pickup itself can be positioned in the interior of the at least one flow duct. The measured value pickup can then be positioned there permanently, but it is also possible for it only to be positioned temporarily in the flow duct during the operation of the device. It is also possible for the measured value pickup itself to be positioned in a secondary chamber or at a distance from the flow duct, with it then being possible, if appropriate, for a signal conductor to be at least temporarily inserted into the flow duct.

With regard to the means for recording an environmental parameter, it is preferred for them to comprise at least one pyrometer. In principle, in particular a sound pyrometer or an infrared pyrometer is suitable for this purpose. In the case of a sound pyrometer, sound transmitters and sound receivers are positioned in one device or more than one device. Sound pulses are then emitted, with it being possible, owing to the dependence of temperature on the speed of sound, for knowledge to be obtained with regard to the temperature and/or the velocity of the flue gas. Measured values can thereby be generated only in certain positions of the fluid distributor, since transmitters and receivers have to be aligned exactly with one another. Accordingly, the use of an infrared pyrometer, also called radiation thermometer, is preferred. This serves in particular for contact-free measurement of the temperature. The infrared radiation of the flue gases, of the flames and/or of the objects in the interior of the boiler can be determined in this manner. The basis is the "Stefan-Bolzmann law", according to which the total radiation capacity for an ideal black body depends on the absolute temperature. An infrared pyrometer, the spectral range of which comprises 3.9 μm and/or 1.1 μm is preferred.

According to a development of the device, it is proposed that the means for recording an environmental parameter are at least partially arranged in a secondary duct which can be decoupled from the flow duct. In principle, the option is therefore provided of decoupling measuring operation and fluid distribution. For this purpose, the fluid distributor is advantageously designed with a curvature in the vicinity of the inlet opening such that the secondary duct can extend essentially in alignment with the outlet opening. In order to prevent the fluid from coming into contact with the means for recording an environmental parameter, said secondary duct can be decoupled. For this purpose, seals, valves, flow flaps or the like can be provided. In principle, it is also possible for the secondary duct to have a connecting point which can be entirely closed by a closure flap or the like. In this case, the means for detecting an environmental parameter can also be temporarily removed from the fluid distributor. However, a permanent connection between the means for recording the environmental parameter and the fluid distributor is preferred since the reproduction of the precise alignment during installation can thereby by avoided. In addition or as alternative, means for protecting the means for recording an environmental parameter from the temperatures, gases and/or pressures prevailing in the interior of the boiler can also be provided.

Furthermore, it is also advantageous that elements for holding the means for recording an environmental parameter are provided in the at least one flow duct. This applies, for example, to the situation in which a signal conductor is arranged in the interior of the flow duct. In order then to align said signal conductor with the outlet opening, it may be necessary to fix it centrally in the flow space. For this purpose, separate elements can be provided temporarily or permanently in the flow duct. A flow influencer which is intended to calm the fluid (after flow through a curvature) in the vicinity of the inlet opening can be cited by way of example as an example of a permanently integrated element. Said flow influencer can be equipped with elements of this type for holding the measured value pickups.

According to a development of the device, the means for moving the fluid distributor comprise a pivoting drive with at least two drives which can be activated independently of each other. The configuration with two linear drives which are designed in particular in a modular construction is very particularly preferred. In this case, for example, the pivoting drive realizes pivoting angles, which can be adjusted independently one another, in the horizontal and vertical direction of up to 110°. With regard to the configuration of the drives, reference should be made in particular to WO 01/65179 A1. The description there of the drives can also be used here to provide a more detailed description.

Furthermore, it is also proposed that means for determining the position of the fluid distributor are provided. In particular, the means for determining the position are combined with the drives of a pivoting operation. For example, displacement and/or angle and/or velocity sensors which are coupled to parts of the drives can be provided. Therefore, on account of the movement paths of the drives, precise conclusions can be drawn as to the position of the fluid distributor. The determination of the position comprises, for example, the position of the fluid distributor with respect to a reference point of the device and/or the alignment of the fluid distributor and/or the inclination of the fluid distributor with respect to the boiler wall. In addition, it is possible for limit switches or the like to be provided, said limit switches being able to serve, for example before the start of the operation of the device, as reference point for the subsequent determination of the position.

According to a further refinement of the device, said device comprises a cleaning appliance for a boiler with a throughflow of flue gas. This involves in particular a cleaning appliance, the fluid distributor of which is configured in the manner of a blasting pipe which can be positioned in a permanently pivotable manner in the wall of a boiler.

In the case of this device, it is particularly preferred that the fluid distributor has a nozzle for forming a fluid jet comprising at least one of the components water and steam, with the nozzle forming the outlet opening. "Nozzle" is understood in particular as meaning a tapering cross section of the flow duct of the fluid distributor in the region of the outlet opening, with the outlet opening ultimately having a diameter in the range of from 6 mm to 8 mm. A measuring beam and a fluid jet can now be discharged into inner regions of the boiler through said nozzle.

In this case, the fluid jet and the measuring beam can preferably span distances of up to 5 meters, if appropriate even up to 10 meters or even up to as much as 18 meters.

Furthermore, a boiler of a combustion system with at least one device of the above-described type according to the invention is proposed, in which the fluid distributor is arranged movably in a boiler wall in such a manner that the outlet opening is located in the interior of the boiler. The configuration is preferred here in which a plurality of devices are fitted in or to the boiler.

Fluid jets or measuring beams which can reach at least most of the interior space of the boiler can be discharged via the fluid distributor outlet opening which projects into the interior region of the boiler. This firstly has the advantage that, with the aid of the fluid jets, the heat exchange bodies and/or boiler walls which can be reached by the fluid distributor can be freed from impurities, but at the same time also relatively large regions can be reached with the measuring beams. The provision of a plurality of devices now makes it possible for regions in the interior of the boiler to be able to be reached by a plurality of measuring beams of different devices, with it being possible, by superimposition of the measured values obtained, for very precise information about the environmental parameter to be obtained.

In this case, it is particularly advantageous that at least two devices are provided in a horizontal level section of the boiler. A "horizontal level section" is understood in particular as meaning a section of the interior space of the boiler that has two substantially horizontal end regions and extends over a certain height. The height of said level section is selected taking the movement of the fluid distributor and/or the extent to which the measuring beam can reach the interior space into consideration. The at least two devices can be arranged lying opposite each other and/or substantially at right angles to each other in order to be able to use simple mathematical algorithms in the processing of the measuring signals and to permit a wide degree of covering in the interior of the boiler. "Opposite" is generally not to be understood as meaning the devices lie exactly aligned opposite each other. On the contrary, a certain amount of offset between the two devices within the level section is preferred. If appropriate, further devices can also be provided in the one horizontal level section. A "right-angled" arrangement is provided in particular when the fluid distributors are oriented essentially perpendicularly in their non-pivoted position with respect to one another. A configuration is particularly preferred here in which the plurality of devices are arranged at a substantially equal distance from one another over the circumference of the level section. Said plurality of fluid distributors are preferably used to together monitor a (horizontal) boiler chamber section with regard to an environmental parameter. In this case, it is in particular also possible to check said boiler chamber section with regard to different environmental parameters (temperature, position of the flames of the fire, flow paths of the flue gas, soiling of the boiler wall and the like), with, if appropriate, different means for recording an environmental parameter being employed and/or the existing means for recording an environmental parameter being operated in a different way (for example with different wavelengths, frequencies, intensities, etc.). Furthermore, it is proposed with regard to the boiler that data processing means are provided for signals of the means for recording an environmental parameter and of the means for determining the position of the at least one fluid distributor. The data processing means can be equipped with software which correlates the signals or measured values of the means for recording an environmental parameter and of the means for determining the position of the at least one fluid distributor with one another and processes them. In particular, in this way the measured values of the environmental parameter within the interior of the boiler can be assigned in a locally precise manner. By means of the superimposition of a plurality of environmental parameters of this type, for example with regard to horizontal or vertical reference planes, exact environmental parameter profiles can be generated and depicted in a plane or even in the three-dimensional space of the boiler. For example, distributions of the temperature and/or velocity of the flue gas and, if appropriate, position and/or behavior of the flame in the interior of the boiler can be determined. As a result, the heat flows, the degree of slag coating, the probability of adhesion, the heat exchange behavior and/or further characteristic values can be forecast and/or generated three-dimensionally and/or with respect to a surface. In addition, the data processing means can be equipped with reference values and/or reference profiles of the recorded environmental parameter such that a comparison of the current measured values with said reference values or profiles can be undertaken. This permits conclusions about the combustion and/or heat exchange operations in the combustion system. This makes it possible to reproduce particularly precise images of the operations in the interior of the boiler. For this purpose, the data processing means can be equipped with storage media and/or visualization means. The data processing means can be designed as a separate constructional unit or else as part of a control system for the combustion system, the boiler and/or the device. Furthermore, it is also possible for the data processing means to interact with "self-learning" logic units such that the evaluation and/or prognosis of the measuring results can be improved over the period of operation.

According to a further aspect of the invention, a method for operating a boiler with a throughflow of flue gas is proposed, wherein the boiler has at least one device according to the above type according to the invention, and wherein the device is used to temporarily distribute a fluid in the boiler and to temporarily record an environmental parameter in the interior of the boiler. The configuration of the method, in which the distribution of the fluid and the recording of the environmental parameter are carried out in separate time intervals is particularly preferred in this case. According thereto, the device is used in one time interval for distributing the fluid or for cleaning the boiler while the device is used in another time interval for recording at least one environmental parameter. The at least one device is very particularly preferably moved during the different time intervals with different sequences of movement, with, for example during a cleaning process or during the distribution of the fluid, a meandering blowing pattern being moved as a function of path or speed while, in the time interval for recording the environmental parameter, the interior space of the boiler being scanned, for example, linearly or on levels. In this case, it is particularly advantageous if a drive system which can be activated separately and independently with regard to the direction of movement is provided for the device. This affords the advantage that the device, which was originally used, for example, only for the cleaning process, can now also be used for recording measured values. The system according to the invention for recording measured values also enables simple retrofitting of known cleaning systems to be undertaken. For this purpose, a fluid distributor has to be supplemented merely by way of means for recording an environmental parameter, with, if appropriate, the associated operating software also having to be adapted.

Furthermore, it is advantageous for the temperature distribution in the boiler to be recorded as the environmental parameter. In particular, the temperature distribution of the flue gas during the operation of the boiler or of the combustion system is meant here. An "online diagnosis" of the combustion behavior (boiler monitoring) is therefore possible. In particular, the position of the temperature maxima with regard to a cross section of the boiler or else a longitudinal section of the boiler can thus be ascertained. In view of the fact that as central an alignment of said temperature maxima in the boiler as possible is desired for uniform utilization of the thermal energy of the flue gas and in order to avoid local accumulations of impurities, a correction of the combustion operations can be rapidly undertaken, if appropriate. The online temperature measurement can also be used to analyze the position of the flame in the boiler and, if appropriate, to influence it.

According to an advantageous development of the invention, the signals of the means for recording an environmental parameter of a plurality of devices are superimposed in such a manner that a measured value is assigned locally in the boiler. For this purpose, the measuring beams of the plurality of devices are at least temporarily superimposed such that, for example, diverse intersecting points or intersecting planes are formed. The superimposition of the environmental parameters enables particularly exact measured values (for example of the temperature distribution) to be generated.

Furthermore, it is also possible for the recorded environmental parameter to be compared with a reference value and, as a function of said comparison, for at least measures for activating a cleaning operation or for influencing the combustion operation to be carried out. A method in which both measures for activating a cleaning operation and for influencing the combustion operation can be carried out as a function of the comparison is particularly preferred here. With regard to the measures for activating a cleaning operation, it is possible, for example, for a selection of the device(s) to be activated for the cleaning to be undertaken, with it additionally also being possible for the manner of operation of the device to be adapted. Furthermore, it is possible to change the heat flows in the interior of the boiler by the type of firing, in particular the supply of combustion media and/or oxidation means (for example air). From said comparison, the combustion operations can thus be regulated by a corresponding position of the combustion media and/or a qualitative and/or quantitative influencing of the supply of oxidation means taking place. This results in a more efficient transfer of heat from the hot flue gas to the heat exchange means in the heat exchangers and/or in the reduction of impurities, such as ash, soot and coatings of slag, adhering to the heat exchangers.

Finally, it is also proposed that the environmental parameters recorded by the device are combined with measured values of further sensors of the boiler. In particular, it is meant by this that, in addition to the means for recording an environmental parameter of the device, further sensors are positioned in and/or on the boiler, which sensors likewise permit conclusions about an (identical or a different) environmental parameter of the boiler. For example, sensors as proposed in DE 196 40 337 can be provided in the boiler. The measured values generated in the vicinity of the boiler wall by means of the sensors can now be correlated with the measured values which have been obtained by the device according to the invention. It can therefore be seen, if appropriate, whether there is actually a poor transfer of heat at one point or whether the hot flue gas is not flowing past said point in the desired manner. Interpretation errors and unnecessary cleaning processes are therefore avoided.

BRIEF DESCRIPTION OF THE DRAWING

The invention and the technical background are explained in more detail below with reference to the attached figures. It should be pointed out that the figures show particularly preferred variant embodiments of the invention, but the latter is not limited thereto. In the figures, schematically.

DETAILED DESCRIPTION

Figure 1:
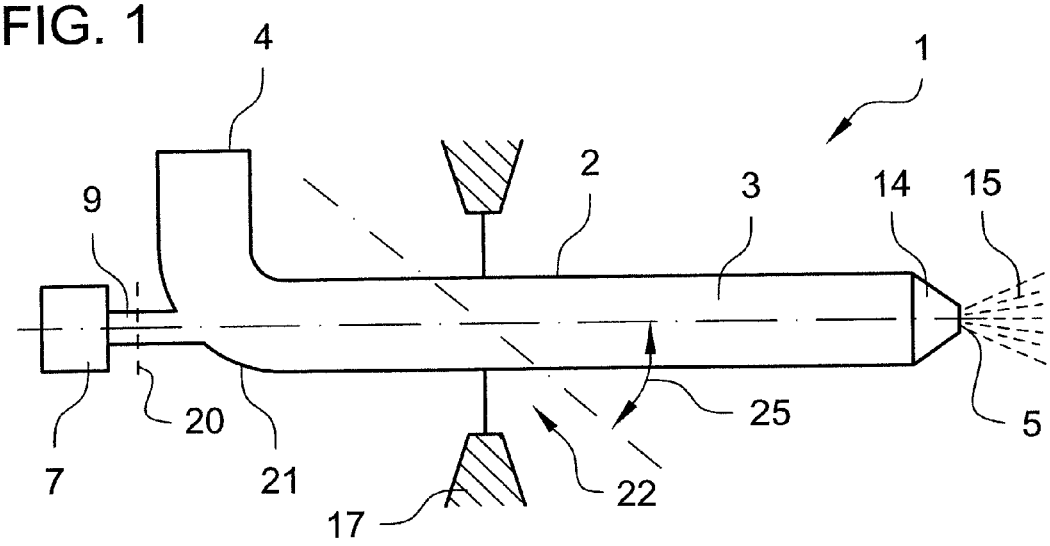
FIG. 1 shows a first variant embodiment of a device according to the invention.

FIG. 1 illustrates a device 1 which comprises a fluid distributor 2 which has a flow duct 3 and is designed with an inlet opening 4 and an outlet opening 5. The fluid enters via the inlet opening 4 into the fluid distributor 2, which is in the manner of a blasting pipe, flows through the curvature 21 and then exits via an outlet opening 5, which is formed by a nozzle 14, as a fluid jet 15. In this case, it is possible for the fluid jet 15 to span distances of up to 30 m. Said fluid jet 15 is used in particular for cleaning off reachable heat exchangers and/or regions of the boiler wall. In order in this case to reach the largest possible areas, the fluid distributor 2 is positioned pivotably in a mounting 22 of the boiler wall 17. The mounting 22 here is designed in such a manner that the fluid distributor 2 can be pivoted at an angle 25 (from one extreme position to the opposite in the region of approx. 90 degrees or even 110 degrees). In addition, it is preferred that the mounting 22, if appropriate, permits a (partial) rotation of the fluid distributor 2, but a movement in the axial direction is prevented. In order to execute said pivoting movement, a pivoting drive (not illustrated) can be provided outside the boiler and is mounted on the outside of the boiler wall 17. Said pivoting drive acts on a fluid distributor sub region located outside the boiler and controls its pivoting movement at any desired, freely determinable movement speed.

In addition, the fluid distributor 2 illustrated has, in the region of the curvature 21, a secondary duct 9 in which a measured value pickup 7 is provided. The secondary duct 9 is oriented in such a manner that an aligned arrangement of measured value pickup 7 and outlet opening 5 is provided. In order to avoid that the fluid can flow during the cleaning process into sub regions of the secondary duct 9 or toward the measured value pickup 7, a shutting-off means 20, for example in the form of a valve, is provided. The measured value pickup 7 is suitable in particular for determining the temperature outside the outlet opening in the interior of the boiler by means of infrared radiation.

Figure 2:
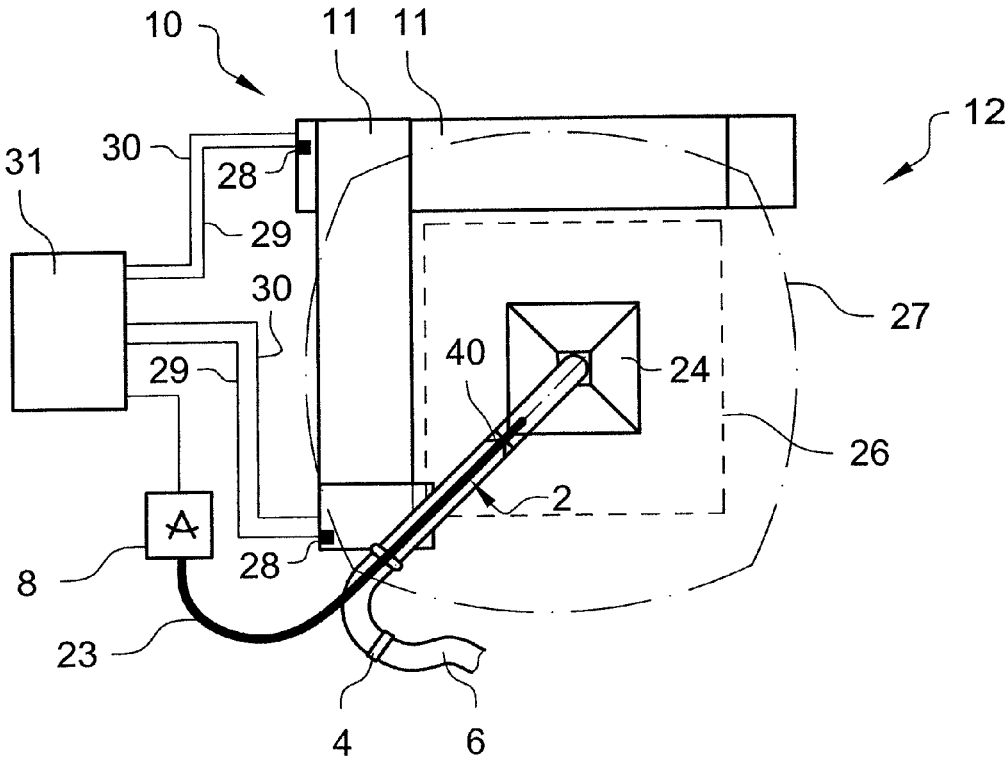
FIG. 2 shows a further variant embodiment of a device according to the invention as a cleaning appliance.

FIG. 2 now illustrates a device which is configured as a cleaning appliance 12 for a boiler with a throughflow of flue gas. For this purpose, the fluid distributor 2 is mounted pivotably in a hatch 24 of the boiler wall 17. In order to realize a pivoting range 27 of the fluid distributor 2, two drives 11 which are constructed modularly and are in the manner of a linear drive are provided. For this purpose, one drive 11 is fixed and movable on the other drive 11. The drives 11 which are arranged perpendicularly to each other can be activated independently of each other such that the articulation of the fluid distributor can reach any desired point within the movement range 26.

The fluid distributor 2 is again designed with an inlet opening 4 to which a supply line 6 for a fluid is connected. The flexible supply line 6 is connected, for example, to a water and/or steam supply. In order to ensure that the fluid jet is configured as uniformly as possible, a flow influencer 40 is provided in the flow duct 3 of the fluid distributor 2. Said flow influencer comprises, for example, flow directing surfaces which ensure a laminar flow of the fluid in the interior of the fluid distributor 2.

Said fluid distributor 2 is now also equipped with means for recording an environmental parameter through the outlet opening 5 (not illustrated). Said means here comprise a pyrometer 8, for example, an infrared pyrometer, which has a signal conductor 23, for example an optical waveguide, which extends into inner regions of the field distributor 2. In order to ensure an exact alignment of the signal conductor 23 with the outlet opening 5, said signal conductor is fixed centrally with the flow influencer 40. In principle, it is possible for said signal conductor 23 to be arranged movably with respect to the fluid distributor 2 and/or the flow duct 3 i.e., for example, during a cleaning process in which the cleaning fluid flows through the fluid distributor, for it to be able to be at least partially removed from said fluid distributor 2.

Furthermore, the cleaning appliance 12 comprises a data processing system 31 which is connected electrically and/or in terms of information to the pyrometer 8 and to the drives 11 of the cleaning appliance 12. The information obtained by means of the pyrometer 8 can be correlated together with the data generated by the displacement gauges 28 of the drives 21 via the data connections 29. As a function of the characteristic values obtained therefrom, it is possible, for example, for specific control commands to be passed via the lines 30 again to the drives 11 such that a selective cleaning of soiled sub regions of the boiler is carried out. Of course, the data processing system 31 illustrated can be connected in the same manner to other and/or further cleaning appliances 12 of the boiler. In addition, the data processing system 31 can comprise storage media, processors and further hardware and software.

Figure 3:
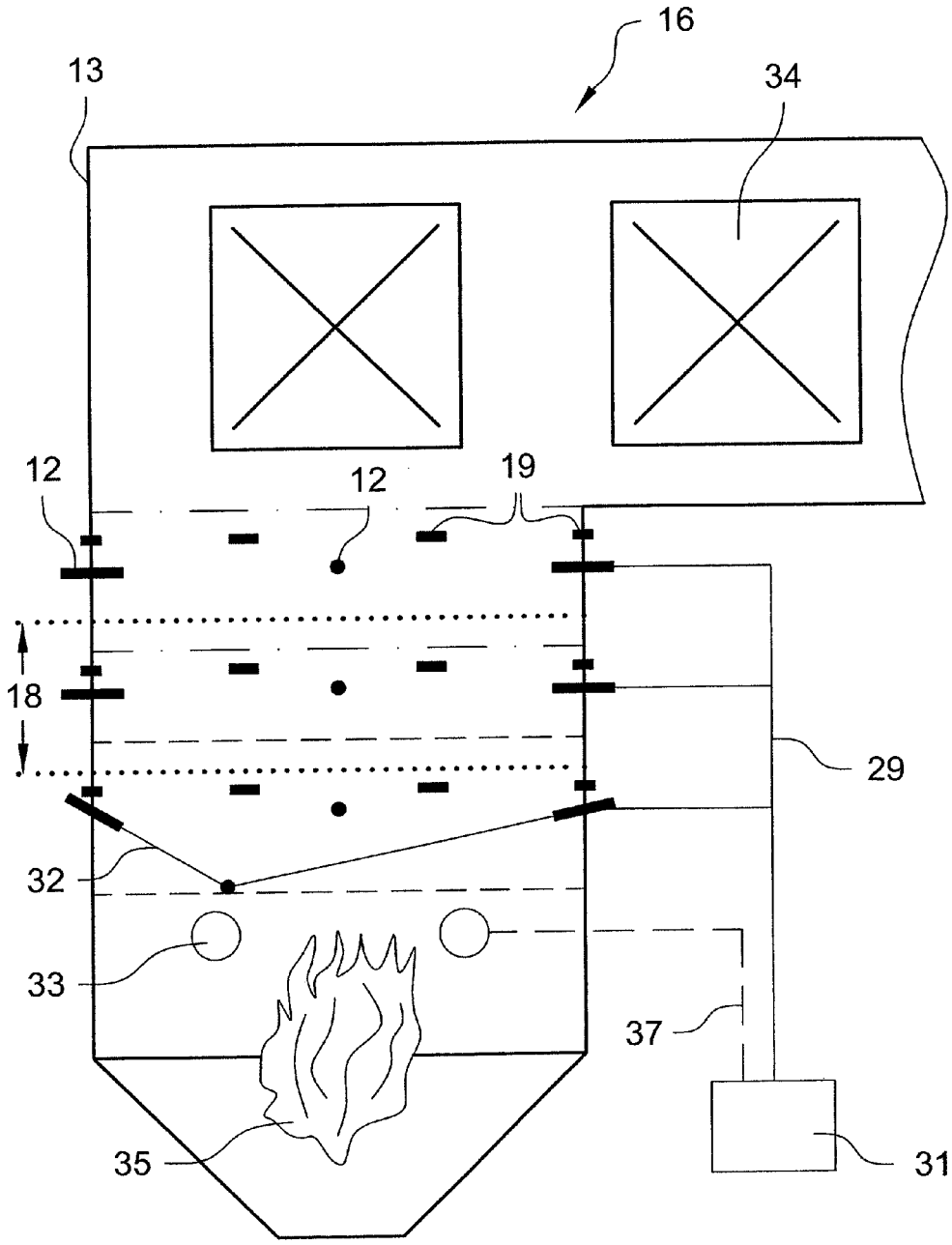
FIG. 3 shows a partial section through a combustion system with a plurality of cleaning appliances according to the invention.

FIG. 3 now shows schematically a cross section through part of a combustion system 16 with a boiler 13 as a throughflow of hot flue gas. A flame 35 is illustrated schematically in the lower region of the boiler 13, said flame being controlled via the burners 33. The burners 33 are used for supplying combustion means and/or oxidation means. The flue gas generated in the process now flows essentially vertically upward to the heat exchangers 34. In addition to the heat exchangers 34, for example in the manner of a tube bundle assembly, illustrated at the top in the boiler 13, further heat exchangers can be provided in the region of the boiler wall between the flame 35 and the heat exchangers 34 illustrated. The hot flue gas comes into contact with the heat exchangers 34, with a heat exchange means (for example water) which flows through the heat exchangers 34 being heated up and therefore the thermal energy of the flue gas being able to be utilized.

The level sections 18 which are designed such that they at least partially overlap are illustrated in the boiler 13. A plurality of devices 1 and/or cleaning appliances 12 are provided in each horizontal level section 18. In the case of the construction illustrated here of the boiler 12 with a substantially rectangular cross section, a cleaning appliance 12 is provided on each side surface in a level section 18. By means of said cleaning appliances 12, those regions of the boiler 13 which lie opposite and/or arranged laterally thereto and/or heat exchangers 34 (not illustrated) which are positioned there are, if appropriate, freed from coatings of slag.

It is schematically illustrated in the lower level section 18 how the measuring beams 32 of opposite cleaning appliances 12 intersect. In this case, average values of the environmental parameter in the interior of the boiler 13 can in each case be determined, with a planar or even three-dimensional distribution of the environmental parameter being able to be determined by superimposition of said measured values obtained by the measuring beams 32.

The information obtained by means of the measuring beams 32 of the cleaning appliances 12 can also be corrected, for example, with measured values and/or signals which have been generated by further sensors 19 in the region of the boiler wall of the boiler 13. It is therefore possible to obtain, in a cost-effective and simple manner, for example a significantly greater density of information with regard to the temperature distribution in the interior of the boiler. The integration of such a measuring system in the cleaning appliances 12 also results in simple retrofitting being possible.

In order to operate the boiler 13 efficiently, the cleaning appliances 12 are connected to a data processing system 31 via data connections 29. As a function of the measured values generated by the cleaning appliances 12 and/or the resultant profiles of the ambient parameter in the interior of the boiler 13, the cleaning operation of the cleaning appliances 12 and the addition of combustion means and/or oxidation means by means of the burners 33 can be selectively and specifically influenced. For this purpose, for example, a coupling 37 of the burners 33 to the data processing system 31 is also provided.

Figure 4:
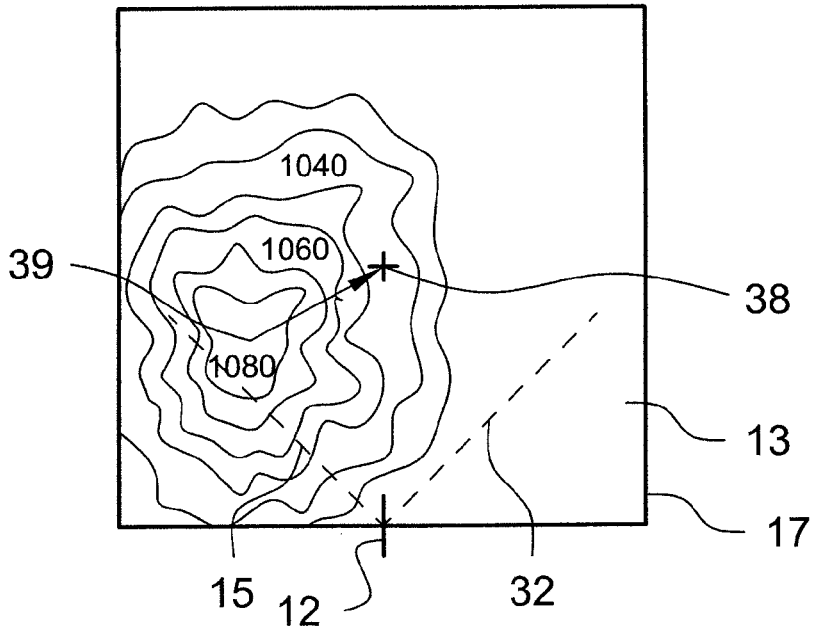
FIG. 4 shows a result of a measured value recording in a horizontal section through the boiler.
Figure 5:
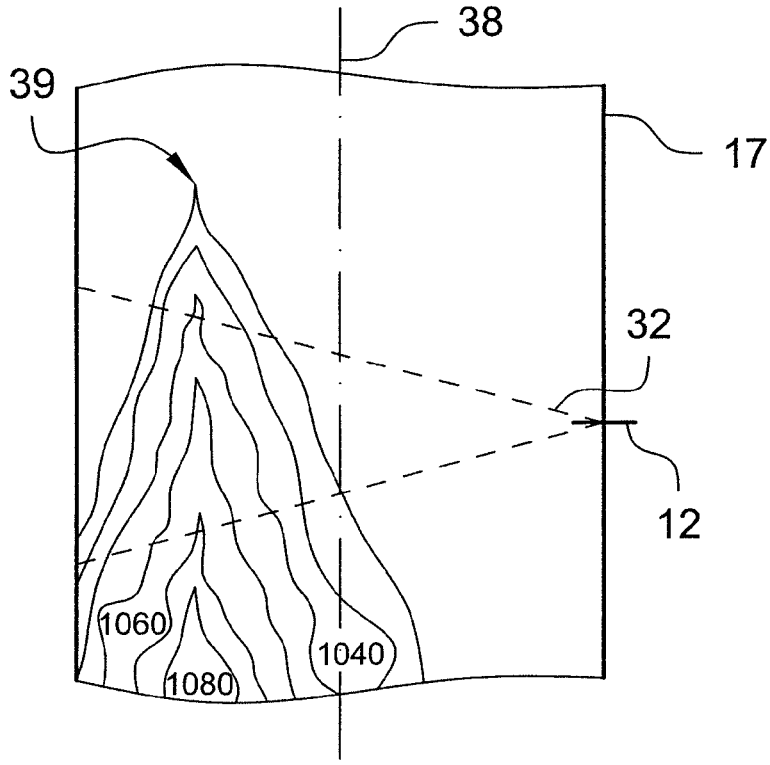
FIG. 5 shows a profile of the recorded environmental parameter in a vertical section of the boiler.

FIGS. 4 and 5 now illustrate results of the measured value recording by means of the device according to the invention. FIG. 4 illustrates a substantially horizontal cross section through a boiler 13. The substantially square construction of the boiler 13 with the boiler walls 17 does not have hot flue gas flowing through it centrally. This error can be seen with reference to the temperature distribution illustrated over said cross section. The values (1080, 1060, 1040) indicated in FIGS. 4 and 5 constitute details in degrees Celsius, with the lines illustrating limit regions of zones of identical temperature. As can be seen in the figures, the maximum 39 of the environmental parameter and/or of the temperature is offset with respect to the center 38 of the boiler 13. This is therefore regularly also associated with a single-sided loading of the boiler 13 with regard to the coating of slag and/or the heat flow. After an erroneous position of this type is identified, it is now possible either for the cleaning in the region of the more heavily or soiled boiler walls 17 to be initiated, but it is also advantageous to displace the position of the maximum 39 toward the center 38 by influencing the combustion operation.

Both FIGS. 4 and 5 additionally illustrate, by way of example, a cleaning appliance 12 schematically in the boiler wall 17, with the pivoting range on each level being illustrated. The dashed line illustrates the limit regions with regard to the pivoting angle for the fluid jet 15 and the measuring beam 32. In view of the fact that it has hitherto already been desirable to position the cleaning appliances 12 in such a manner that, as far as possible, all essential parts of the boiler wall 17 can be reached, said degree of covering can now also be used for complete recording of the environmental parameter in the interior of the boiler 13. This cost-effective addition to a combustion system of this type permits selective cleaning of the boiler walls 17 of the boiler 13 and a particularly efficient operation of the combustion system.

| List of Reference Numbers | |
|---|---|
| 1 | Device |
| 2 | Fluid distributor |
| 3 | Flow duct |
| 4 | Inlet opening |
| 5 | Outlet opening |
| 6 | Supply line |
| 7 | Measured value pickup |
| 8 | Pyrometer |
| 9 | Secondary duct |
| 10 | Pivoting drive |
| 11 | Drive |
| 12 | Cleaning appliance |

-continued

| List of Reference Numbers | |
|---|---|
| 13 | Boiler |
| 14 | Nozzle |
| 15 | Fluid jet |
| 16 | Combustion system |
| 17 | Boiler wall |
| 18 | Level section |
| 19 | Sensor |
| 20 | Shutting-off means |
| 21 | Curvature |
| 22 | Mounting |
| 23 | Signal conductor |
| 24 | Hatch |
| 25 | Angle |
| 26 | Movement range |
| 27 | Pivoting range |
| 28 | Displacement gauge |
| 29 | Data connection |
| 30 | Line |
| 31 | Data processing system |
| 32 | Measuring beam |
| 33 | Burner |
| 34 | Heat exchanger |
| 35 | Flame |
| 36 | Connection |
| 37 | Coupling |
| 38 | Center |
| 39 | Maximum |
| 40 | Flow influencer |

What is claimed is:

1. A device comprising a fluid distributor which has at least one flow duct with an inlet opening and an outlet opening, wherein the inlet opening can be connected to a supply line for a fluid, and means for moving the fluid distributor are provided, wherein means are provided for recording an environmental parameter through the outlet opening of the flow duct having a value pickup and wherein the value pickup is arranged inside of the flow duct or the value pickup is arranged at least partly in a secondary duct wherein the secondary duct is orientated in such a manner that an aligned arrangement of measured value pickup and outlet opening is provided.

2. The device as claimed in claim 1, in which the means for recording an environmental parameter comprise at least one measured value pickup which is arranged connected to the at least one flow duct.

3. The device as claimed in claim 1, in which the means for recording an environmental parameter comprise at least one pyrometer.

4. The device as claimed in claim 1, in which the means for recording an environmental parameter are at least partially arranged in a secondary duct which can be decoupled from the flow duct.

5. The device as claimed in claim 1, in which elements for holding the means for recording an environmental parameter are provided in the at least one flow duct.

6. The device as claimed in claim 1, in which the means for moving the fluid distributor comprise a pivoting drive with at least two drives which can be activated independently of each other.

7. The device as claimed in claim 1, in which means for determining the position of the fluid distributor are provided.

8. The device as claimed in claim 1, in which the device comprises a cleaning appliance for a boiler with a through-flow of flue gas.

9. The device as claimed in claim 8, in which the fluid distributor has a nozzle for forming a fluid jet comprising at least one of the components water and steam, with the nozzle forming the outlet opening.

10. A boiler of a combustion system with at least one device, each device comprising a fluid distributor which has at least one flow duct with an inlet opening and an outlet opening, wherein the inlet opening can be connected to a supply line for a fluid, and means for moving the fluid distributor are provided, wherein means are provided for recording an environmental parameter through the outlet opening of the flow duct having a value pickup and wherein the value pickup is arranged inside of the flow duct or the value pickup is arranged at least partly in a secondary duct wherein the secondary duct is orientated in such a manner that an aligned arrangement of measured value pickup and outlet opening is provided, and wherein the fluid distributor is arranged movably in a boiler wall in such a manner that the outlet opening is located in the interior of the boiler.

11. The boiler as claimed in claim 10, in which at least two devices are provided in a horizontal level section of the boiler.

12. The boiler as claimed in claim 10, in which data processing means are provided for signals of the means for recording an environmental parameter and of the means for determining the position of the at least one fluid distributor.

13. A method for operation of a boiler with a throughflow of flue gas, wherein the boiler has at least one device, each device comprising a fluid distributor which has at least one flow duct with an inlet opening and an outlet opening, wherein the inlet opening can be connected to a supply line for a fluid, and means for moving the fluid distributor are provided, wherein means are provided for recording an environmental parameter through the outlet opening of the flow duct having a value pickup and wherein the value pickup is arranged inside of the flow duct or the value pickup is arranged at least partly in a secondary duct wherein the secondary duct is orientated in such a manner that an aligned arrangement of measured value pickup and outlet opening is provided, the device being used to distribute a fluid in the boiler in a first time interval and to record an environmental parameter in the interior of the boiler in a second time interval.

14. The method as claimed in claim 13, wherein the temperature distribution in the boiler is recorded as the environmental parameter.

15. The method as claimed in claim 13, wherein the signals of the means for recording an environmental parameter of a plurality of devices are superimposed in such a manner that a measured value is assigned locally in the boiler.

16. The method as claimed in claim 13, wherein the recorded environmental parameter is compared with a reference value and, as a function of said comparison, at least measures for activating a cleaning operation or for influencing the combustion operation are carried out.

17. The method as claimed in claim 13, wherein the environmental parameters recorded by the device are combined with measured values of further sensors of the boiler.

18. The method as claimed in claim 13, wherein the measured value pickup is arranged to measure along an axis that passes through the outlet opening.

19. The method as claimed in claim 18, wherein the measured value pickup includes an optical waveguide disposed at least partially within the flow duct and extending to a pyrometer outside of the flow duct.

20. The method as claimed in claim 13, wherein the fluid distributor includes a shut-off between the flow duct and the secondary duct, wherein the fluid distributor is arranged to pass fluid from the inlet opening to the outlet opening when the shut-off is closed and to measure environmental parameters when the shut-off is open.

* * * * *